United States Patent [19]

Kaufmann

[11] 4,106,530

[45] Aug. 15, 1978

[54] HEDDLE FRAME

[76] Inventor: Frank H. Kaufmann, c/o Steel Heddle Manufacturing Co., P.O. Box 1867, Greenville, S.C. 29602

[21] Appl. No.: 827,441

[22] Filed: Aug. 24, 1977

Related U.S. Application Data

[63] Continuation-in-part of Ser. No. 734,823, Oct. 22, 1976.

[51] Int. Cl.[2] ..... D03D 9/00

[52] U.S. Cl. ..... 139/92

[58] Field of Search ..... 139/91, 92, 93

[56] References Cited

U.S. PATENT DOCUMENTS

| | | | |
|---|---|---|---|
| 2,674,274 | 4/1954 | Blickenstorfer | 139/92 |
| 2,845,953 | 8/1958 | Wagner | 139/92 |
| 3,754,577 | 8/1973 | Heller | 139/92 |

FOREIGN PATENT DOCUMENTS

| | | | |
|---|---|---|---|
| 1,308,326 | 2/1973 | United Kingdom | 139/92 |

*Primary Examiner*—Henry S. Jaudon

*Attorney, Agent, or Firm*—Zachary T. Wobensmith, 2nd; Zachary T. Wobensmith, III

[57] ABSTRACT

Heddle frames are disclosed which have heddle supporting rods with provisions for impact resistance, for reduction of wear and abrasion, and for noise reduction, which is accomplished by using heddle rods with impact absorbing material at the impact and wear surfaces which contact the heddles. The heddle supporting rods in long frames may be supported intermediate their ends, and the heddles may have C, J, or O shaped end eyes, different heddle rod cross sections and be of differing materials depending upon the requirements of the particular installation.

7 Claims, 10 Drawing Figures

HEDDLE FRAME

CROSS REFERENCE TO RELATED APPLICATION

This application is a continuation-in-part of my prior copending U.S. Patent Application Ser. No. 734,823, filed Oct. 22, 1976.

BACKGROUND OF THE INVENTION

1. Field of the Invention

This invention relates to heddle frames and more particularly to improvements in the heddle supporting rods used in such frames.

2. Description of the Prior Art

It is common in the weaving art to employ heddle frames having rods on which the heddles are mounted. These rods have usually been made of steel strips which are mounted in the frame and on which the heddles are freely movable. One illustration of such rods is in the U.S. patent to C. F. Kramer, U.S. Pat. No. 3,417,788.

The vertical movement of the heddle frames in shedding and the inertia effect of the heddles at the ends of each cyclic movement results in impact stresses in the heddles and on the heddle rods with resultant noise and wear, particularly at the contact points of the end eyes of the heddles and the heddle rods.

The horizontal movement of the heddles on the heddle rods also has an abrasive effect with attendant wear on the end eyes and the heddle rods.

Various solutions have been proposed to reduce wear as shown in the U.S. patent to Heller, U.S. Pat. No. 754,577 but the noise and wear are still present.

While my prior patent application discloses one approach to solving the heddle rod noise and wear problem it is not suitable for many variations of heddles and heddle supporting rods.

SUMMARY OF THE INVENTION

In accordance with the invention a heddle frame is provided in which the heddle support rods at the locations of contact by the end eyes of the heddles are covered with a material which resists adverse impact action, reduces wear and abrasion and reduces noise.

It is the principal object of the invention to provide a heddle frame in which the effects of impact of the end eyes of the heddles on their supporting bars are reduced so that there is less wear and abrasion, noise is reduced and the service life of the heddle rods and heddles is increased.

It is a further object of the invention to provide a heddle frame which is simple and inexpensive to construct and in which the wear surfaces of the heddle support rods can be easily repaired or renewed.

It is a further object of the invention to provide a heddle frame which can be used with various heddle end eye configurations and various supporting rod cross sections.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
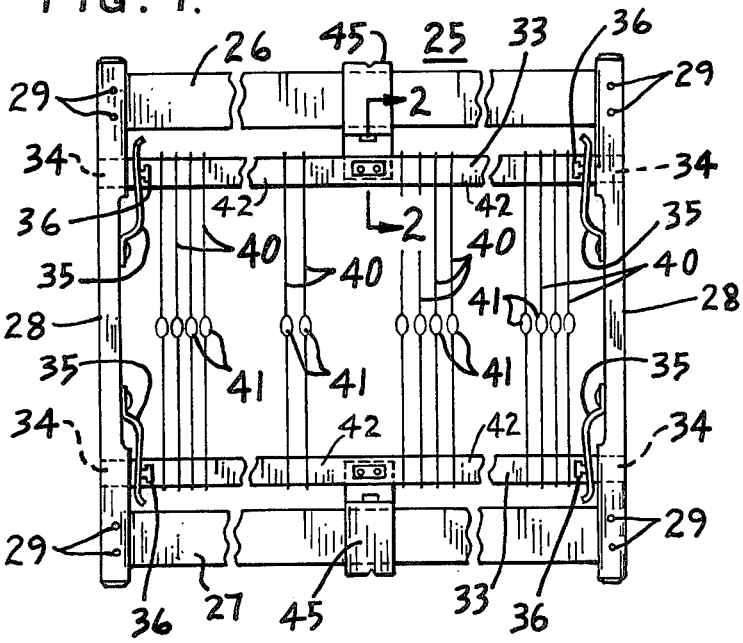
FIG. 1 is a front elevational view of a portion of a heddle frame with heddle rods of a preferred embodiment incorporated therein.

It should, or course, be understood that the description and drawings herein are illustrative merely and that various modifications and changes can be made in the structures disclosed without departing from the spirit of the invention.

DESCRIPTION OF THE PREFERRED EMBODIMENTS

Referring now more particularly to FIGS. 1, 2, 3, and 4 of the drawings, a heddle frame 25 is shown of well know type with top and bottom rails 26 and 27 and side struts 28 connecting the ends of the rails 26 and 27 and maintaining them in spaced parallel relation. The side struts 28 can be held in engagement with the rails 26 and 27 in any desired manner, such as by screws 29.

The rails 26 and 27 are advantageously made of flat steel tubing or extrusions of light weight metal alloys, such as aluminum or magnesium, with opposite parallel side faces 30 and opposite inner and outer faces 31 and 32.

The heddle frame 25 as illustrated has mounted thereon upper and lower heddle supporting rods 33, which may have their ends extending into openings 34 in the side struts 28, and retained in place by spring clips 35 engaged in T-shaped apertures 36 in the rods 33. The heddle supporting rods 33 support a plurality of heddles 40 with central warp eyes 41 for controlling the shed, and with end eyes 42, with one of the side shanks being cut away as at 43 to permit the heddles 40 to pass freely from end to end on rods 33 when the heddles 40 are supported in the heddle frame 25. The formation of end eyes 42 for this purpose may be as shown in U.S. Pat. Nos. 2,047,511 and 2,386,690.

The heddle supporting rods 33 can be supported intermediate their ends, in any desired manner, such as by rail attachments 45 which are disposed in surrounding relation to the rails 26 and 27 and may be of a type such as shown in the U.S. patent to Kramer, U.S. Pat. No. 3,417,788.

The heddle supporting rods 33 are preferably made as rolled metal strip or metal extrusions and include vertical portions 50 with their upper margins carrying inserts 51 with curved outer faces 52.

The inserts 51 are preferably of a synthetic plastic material which is resistant to impact, wear and abrasion and has a low coefficient of friction with respect to the inner portions of the end eyes 42 in engagement therewith during use.

Suitable materials include thermoplastics such as nylon, urethane and polyester, and rubber.

The inserts 51 may be loosely supported by or frictionally retained to the rods 33 or if desired may be adhesively attached thereto in a well known manner.

Figure 2:
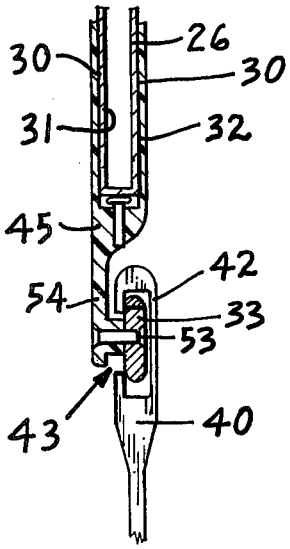
FIG. 2 is a vertical sectional view, enlarged, taken approximately on the line 2—2 of FIG. 1.
Figure 3:
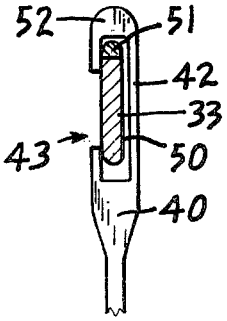
FIG. 3 is a vertical sectional view similar to FIG. 2, showing another embodiment of heddle support rod.

The vertical portions 50 of the rods 33 can be supported between the ends in any desired manner, a preferred support being provided, as shown in FIG. 2, by rivets 53 which engage the rods 33 and vertical flanges 54 of the rail attachments 45.

Figure 5:
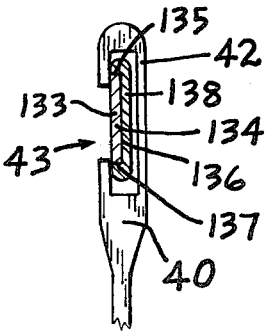
FIG. 5 is a vertical sectional view similar to FIG. 3 illustrating another embodiment of heddle support rod.
Figure 6:
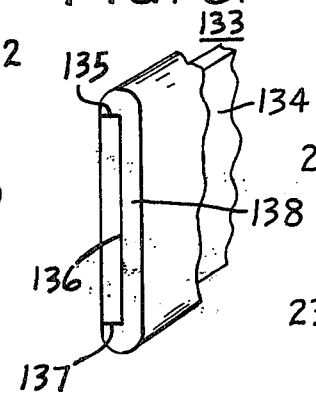
FIG. 6 is a fragmentary perspective view, enlarged, of the heddle support rod of FIG. 5.

Referring now more particularly to FIGS. 5 and 6 of the drawings another embodiment of heddle support rod 133 is illustrated carrying a heddle 40 and which rod 133 includes a vertical portion 134 which is preferably attached to the rail attachments in any desired manner. The rod 133 is preferably formed of metal and has the upper margin 135, outer side 136 and lower margin 137 covered by an insert 138 which is adhesively secured to the rod 133. The insert 138 is also preferably formed of synthetic plastic material such as that referred to for inserts 51.

Figure 7:
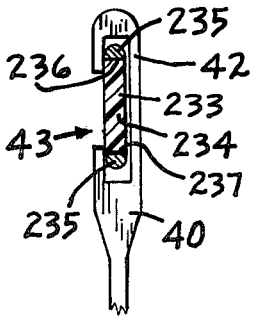
FIG. 7 is a vertical sectional view similar to FIG. 3 illustrating another embodiment of heddle support rod.
Figure 8:
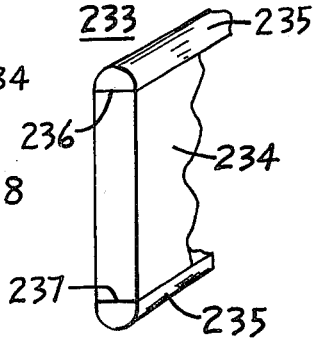
FIG. 8 is a fragmentary perspective view, enlarged, of the heddle support rod of FIG. 7.

Referring now more particularly to FIGS. 7 and 8, another embodiment of heddle support rod 233 is illustrated carrying a heddle 40 and which rod includes a vertical portion 234 which can be attached to the rail attachments in any desired manner. The vertical portion 234 has inserts 235 carried on its upper and lower margins 236 and 237. The inserts 235 are preferably formed of graphite and are adhesively secured to the margins 236 and 237 in well known manner. The vertical portion 234 as illustrated is formed of fiberglass.

Figure 9:
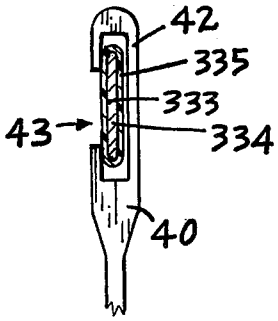
FIG. 9 is a vertical sectional view similar to FIG. 3 illustrating still another embodiment of heddle support rod.
Figure 4:
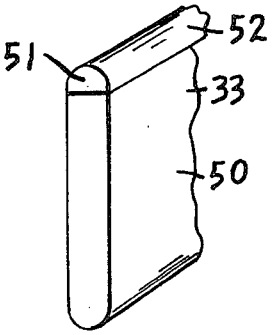
FIG. 4 is a fragmentary perspective view, enlarged, of the heddle support rod of FIG. 3.
Figure 10:
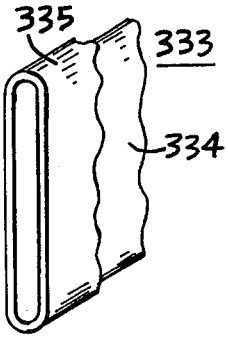
FIG. 10 is a fragmentary perspective view, enlarged, of the heddle support rod of FIG. 9.

Referring now more particularly to FIGS. 9 and 10, still another embodiment of heddle support rod 333 is illustrated carrying a heddle 40 and which rod includes a vertical portion 334 which is enclosed by an outer covering 335 of a synthetic plastic material which is resistant to impact, wear and abrasion and has a low coefficient of friction with respect to the inner portions of the end eyes 42, in engagement therewith during use, and can be of a material such as is disclosed for inserts 51 above. The rod 333 as illustrated is preferably formed of metal.

The rod 333 can be attached to the rail attachments (not shown) in any desired manner such as by a suitable adhesive or by rivets as shown for rods 33.

It will thus be seen that structure has been provided with which the objects of the invention are achieved.

I claim:

1. In a heddle frame having top and bottom frame rails, heddle supporting rods carried on said frame and heddles having end eyes carried on said rods, the improvement in said heddle supporting rods which comprises an upper rod with a central rod portion and having an upper edge portion for engagement with the upper end margin of the upper end eye and a lower rod with a central rod portion and having a lower edge portion for engagement with the lower margin of the lower end eye, and each of said edge portions comprises a longitudinally extending non-metallic non-ceramic portion of less impact noise response for reducing impact noise.

2. The combination defined in claim 1 in which said non-metallic portion is of synthetic plastic material.

3. The combination defined in claim 1 in which said non-metallic portion is adhesively secured to said margins.

4. The combination defined in claim 1 in which said non-metallic portion is of rubber material.

5. The combination defined in claim 1 in which said non-metallic portion is loosely retained between the interior of said end eyes and the central rod portion.

6. The combination defined in claim 1 in which said central rod portion is of metal.

7. The combination defined in claim 1 in which said central rod portion is of fiberglass.

* * * * *